United States Patent [19]

Hanko et al.

[11] Patent Number: 4,836,364

[45] Date of Patent: Jun. 6, 1989

[54] SHADOW BOX CARTON WITH STRUT IMPROVEMENT

[75] Inventors: Jimmy J. Hanko, Lexington, Ky.; Lawrence V. Brom, Hickory, N.C.

[73] Assignee: Gulf States Paper Corporation, Tuscaloosa, Ala.

[21] Appl. No.: 162,944

[22] Filed: Mar. 1, 1988

[51] Int. Cl.[4] ..... B65D 5/50

[52] U.S. Cl. ..... 206/45.14; 206/45.31

[58] Field of Search ..... 206/45.14, 45.19, 45.31; 229/120.15, 120.18, 120.21

[56] References Cited

U.S. PATENT DOCUMENTS

| | | | |
|---|---|---|---|
| Re. 28,530 | 8/1975 | D'Alessio | 206/45.14 |
| 2,660,361 | 11/1953 | Tyrseck | 229/120.15 |
| 2,909,311 | 10/1959 | Levitt | 229/28 |
| 3,135,453 | 6/1964 | Struble | 229/27 |
| 3,360,118 | 12/1967 | Hanson et al. | 206/45.14 |
| 3,575,286 | 4/1971 | Rosenburg | 206/45.14 |
| 3,669,253 | 6/1972 | Hanko | 206/45.14 |
| 3,687,279 | 8/1972 | Stone | 206/45.14 |
| 3,731,873 | 5/1973 | Brangle, Jr. | 229/41 |
| 3,819,035 | 6/1974 | Jaeschke | 206/45.14 |
| 3,835,987 | 9/1974 | Growney | 206/45.14 |
| 3,946,935 | 3/1976 | Bonczyk | 229/49 |
| 4,105,154 | 8/1978 | Meyers et al. | 229/27 |
| 4,155,445 | 5/1979 | Roccatorte | 206/45.14 |
| 4,264,006 | 4/1981 | Swanberg | 206/45.14 |
| 4,274,578 | 6/1981 | Montealegre | 229/120.21 |
| 4,385,687 | 5/1983 | Dutcher | 206/45.14 |
| 4,530,460 | 7/1985 | Hinton | 229/52 B |

*Primary Examiner*—Gary Elkins

*Attorney, Agent, or Firm*—Cushman, Darby & Cushman

[57] ABSTRACT

A strut improvement in an erectable carton of the shadow box type. The improved strut is provided from the carton material forming the carton blank which extends from a pair of corresponding non-common sides of two side-by-side panels which are retained in side-by-side relation as part of one pair of side-by-side panel structures when the blank is in a flattened preform condition. The strut includes a first end portion having an integral hinge connection with one of the two panels along the corresponding side thereof, a substantial central portion free of connnection with the corresponding sides of the two panels, and a second end portion having an integral hinge connection with the other of the two panels along the corresponding side thereof. The strut is folded along the hinge connections so as to bring the first end portion into surface-to-surface engagement with the one of the two panels and the second end portion into surface-to-surface engagement with the other of the two panels. The two end portions are secured in such surface-to-surface engagement. The arrangement is such that when the blank is erected from its flattened preform condition into a rectangular tubular condition the strut is moved into an angular relationship within the carton space.

23 Claims, 3 Drawing Sheets

SHADOW BOX CARTON WITH STRUT IMPROVEMENT

This invention relates to erectable carton and more particularly to improvements in erectable cartons of the shadow box type.

Erectable shadow box type cartons are known. The carton is initially formed from a flat blank of carton material cut and scored to form an array of side-by-side panels joined along common sides, each defined by four sides including one or two of the common sides. Side flaps are cut from the carton material extending from certain of the remaining non-common sides of the panels and a strut is cut from the material extending from a free side of the array parallel with the common sides. The blank is folded along common sides and secured in lapped relation in a flattened preform condition so as to form a first pair of side-by-side panel structures disposed in abutting coextensive relation with a second pair of side-by-side panel structures. In this condition, a free end of the struct is disposed in surface-to-surface engagement with a panel having a common side with a panel which has a common side with the strut. The blank is erectable from the flattened preform condition into a rectangular tubular condition wherein each pair of side-by-side panel structures are moved from the side-by-side relation into a perpendicular relationship with one another and the strut is moved to extend across and within a side portion of the space defined by the pairs of perpendicularly related panel structures with the side flaps being foldable about their associated panel sides into side-closing relation with respect to the space. One of the panel structures is cut and scored to permit entry of an object therethrough into the remaining portion of the space and to retain the object in shadow box fashion against unwanted movement in a direction outwardly through the one-panel structure while the strut prevents movement in a direction between the closed side flaps. In this known arrangement, the fact that the strut must be cut from carton material extending in the direction of the array of side-by-side panels results in significant wastage in cutting the flat blank.

It is an object of the present invention to provide an improvement in an erectable carton of the type described which eliminates the need to cut the strut from material extending in the direction of the array and hence enables the carton to be contructed with less wastage and hence a more cost effective manner. In accordance with the principles of the present invention, this objective is achieved by cutting the strut from the carton material extending from a pair of corresponding non-common sides of two side-by-side panels which are retained in side-by-side relation as part of one pair of side-by-side panel structures which the blank is in flattened preform condition. The strut includes a first end portion having an integral hinge connection with one of the two panels along the corresponding side thereof, a substantial central portion free of connection with the corresponding sides of the two panels, and a second end portion having an integral hinge connection with the other of the two panels along the corresponding side thereof. The strut is folded along the hinge connections so as to bring the first end portion into surface-to-surface engagement with the one of the two panels and the second end portion into surface-to-surface engagement with the other of the two panels. The two end portions are secured in such surface-to-surface engagement. The arrangement is such that when the blank is erected from its flattened preform condition into its rectangular tubular condition the strut is moved into a functional relationship similar to that of the strut of the prior art.

Preferably, the central portion of the strut includes three longitudinally spaced transversely extending crease lines dividing the same from the end portions into two sections operable to assume an angular relationship of approximately 113° with respect to one another when the blank is erected into rectangular tubular condition.

Another object of the present invention is the provision of a strut improvement in a flat blank of carton material cut and scored to form an array of side-by-side panels joined along common sides, each defined by four sides including one or two of the common sides, a strut cut from the carton material, and side flaps cut from the carton material extending from certain of the remaining sides of the panels other than the common sides. The blank is foldable along common sides and securable in lapped relation in a flattened preform condition so as to form a first pair of side-by-side panel structures disposed in abutting coextensive relation with a second pair of side-by-side panel structures. The blank is erectable from the flattened preform condition into a rectangular tubular condition wherein each pair of side-by-side panel structures are moved from said side-by-side relation into a perpendicular relationship with one another and the strut is moved within a side portion of the space defined by the pairs of perpendicularly related panel structures with the side flaps being foldable about their associated panel sides into side-closing relation with respect to the space. One of the panel structures is cut and scored to permit entry of an object therethrough into the remaining portion of the space and to retain the object in shadow box fashion against unwanted movement in a direction outwardly through the one panel structure while the strut prevents movement in a direction between the closed side flaps. The strut improvement comprises the feature of cutting the strut from the carton material extending from a pair of corresponding non-common sides of two side-by-side panels. The strut is cut to include a first end portion having an integral hinge connection with one of the two panels along the corresponding side thereof, a substantial central portion free of connection with the corresponding sides of the two panels and a second end portion having an integral hinge connection with the other of the two panels along the corresponding side thereof.

Still another object of the present invention is the provision of a package comprising a carton of flat carton material erected to define an interior space. The carton includes first and second flat panels of carton material integrally joined along a common side forming one dimension of the erected carton. The first and second panels have first and second flat surfaces respectively disposed at right angles with respect to one another which define a portion of the interior space. The first and second panels also have first and second perpendicular sides respectively extending outwardly at right angles from one another from one end of the common side. An elongated strip of carton material is provided having a first end portion, a relatively long central portion and a second end portion, the first end portion having a side integral and common with the first perpendicular side of the first panel. The first end portion is hinged along the side thereof common with the first perpendicular side into surface-to-surface engagement with the first surface of said first panel where it is secured by glue. The second end portion has a side integral and common with the second perpendicular side of the second panel, the second end portion being hinged along the side thereof common with the second perpendicular side into surface-to-surface engagement with the second surface of the second panel where it is secured by glue. The central portion of the strip extends within the interior space between the first and second surfaces of the first and second panels.

Another object of the present invention is the provision of a blank, an erectable carton, and a package of the type described which is simple in construction, effective in operation, and economical to manufacture.

These and other objects of the present invention will become more apparent during the course of the following detailed description and appended claims.

The invention may best be understood with reference to the accompanying drawings wherein an illustrative embodiment is shown.

IN THE DRAWINGS

Figure 1:
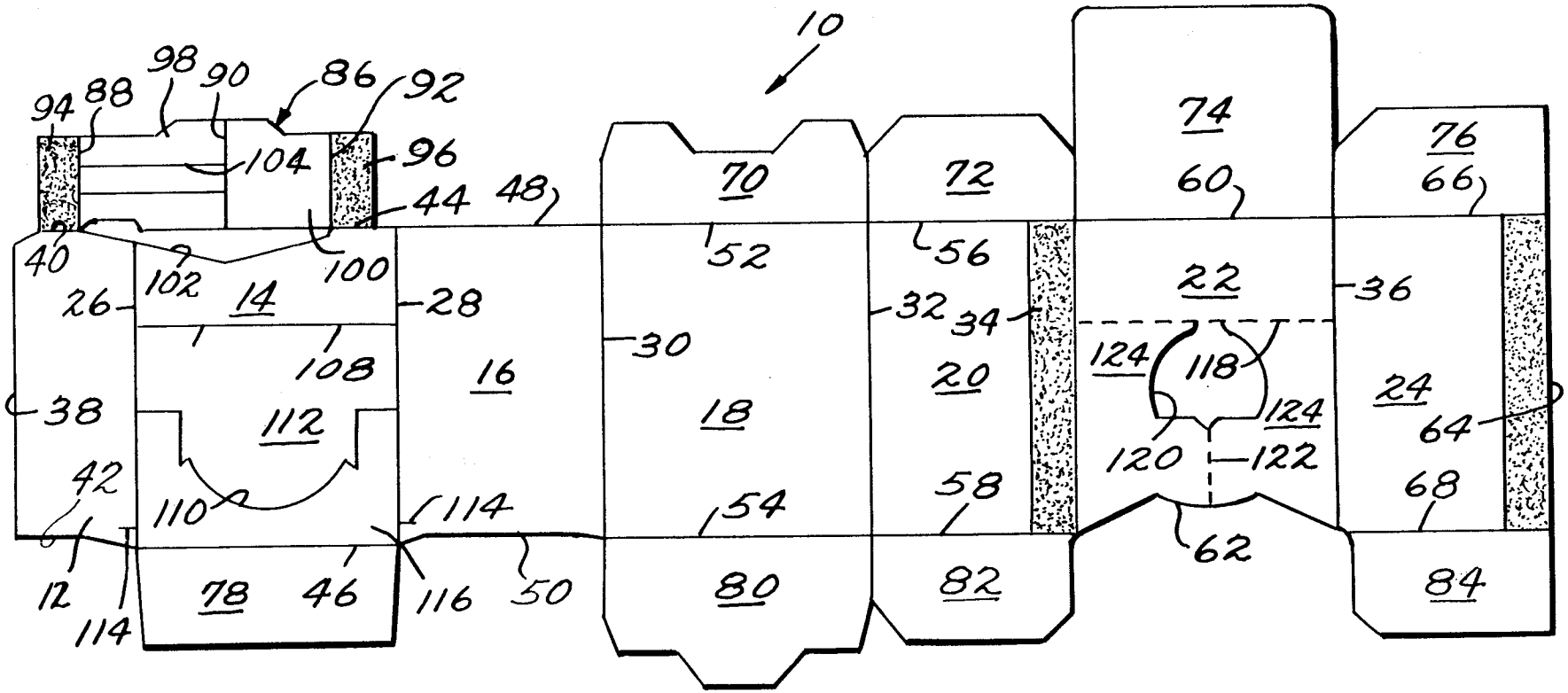
FIG. 1 is a side elevational view of a flat blank of carton material cut and scored in accordance with the principles of the present invention.
Figure 5:
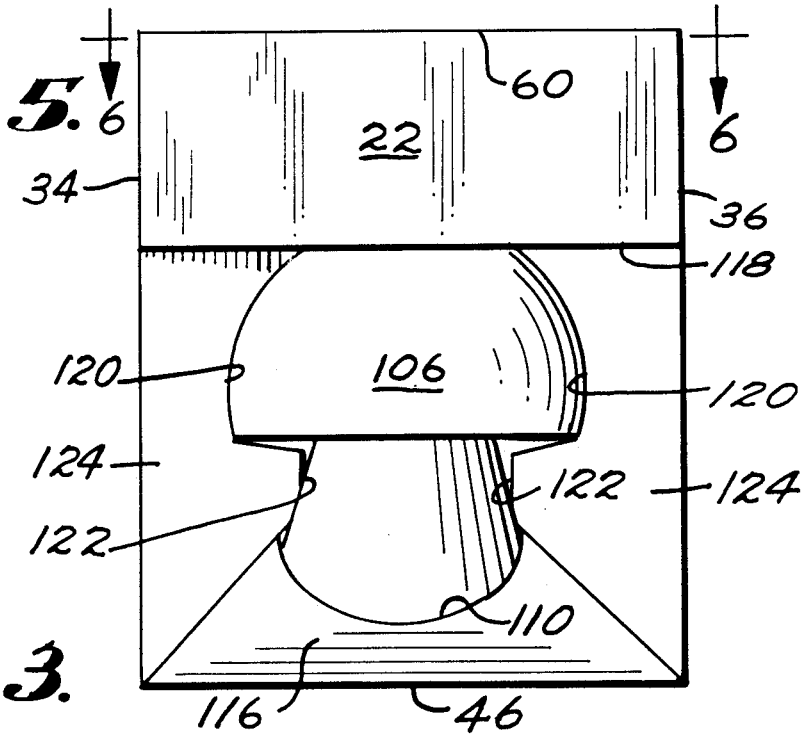
FIG. 5 is a front elevational view showin the blank in its erected condition containing an object.
Figure 3:
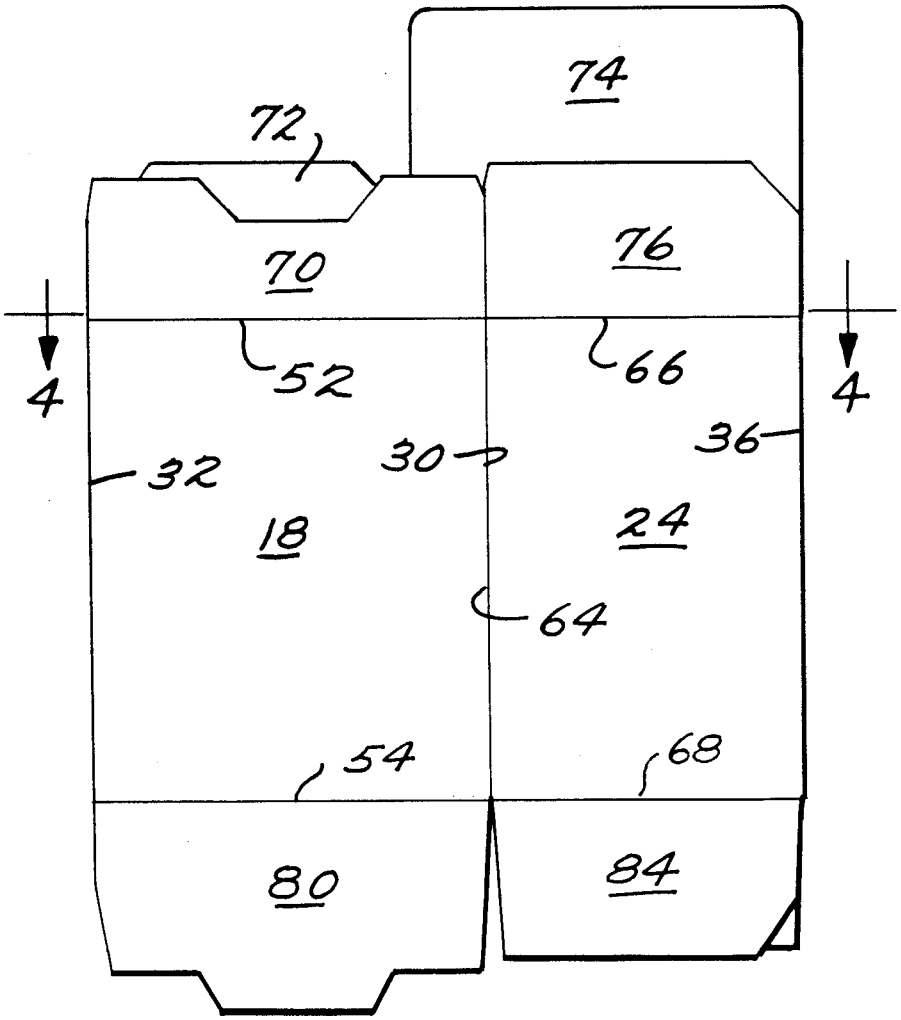
FIG. 3 is a side elevational view of the blank in the aforesaid flattened preform condition.

Referring now more particularly to FIG. 1 of the drawings, there is shown therein a flat blank of carton material such as kraft paperboard or the like, generally indicated at 10, embodying the improvement according to the principles of the present invention. The blank 10 is foldable and securable in lapped relation in a flattened preform condition, such as shown in FIG. 3, and then is erectable into a carton forming a part of a shadow box package, as shown in FIG. 5. As shown in FIG. 1, the blank 10 is cut and scored to form an array of side-by-side panels which are designated by numerals 12, 14, 16, 18, 20, 22, and 24. The panels are joined along common sides 26, 28, 30, 32, 34, and 36. Each panel is defined by four sides including one or two of the common sides. As shown, the panel 12 is a partial width first side panel defined by common side 26, a cut parallel side 38, and two remaining perpendicular sides 40 and 42. Panel 14 is a inner front panel defined on two sides by the common sides 26 and 28 and by two other perpendicular sides 44 and 46. The panel 16 constitutes a second inner side panel and is defined by common sides 28 and 30 and by two additional perpendicular sides 48 and 50, both of which are cut. The panel 18 constitutes a back panel and is defined by common sides 30 and 32 and by two additional perpendicular sides 52 and 54. The panel 20 constitutes an outer full width first side panel and is defined by common sides 32 and 34 and two additional perpendicular sides 56 and 58. The panel 22 constitutes an outer front panel and is defined by common sides 34 and 36 and by two additional perpendicular sides 60 and 62, the latter of which is cut. The panel 24 constitutes an outer second side panel and is defined by common side 36, parallel cut side 64 and two additional perpendicular sides 66 and 68. The carton material along the non-cut perpendicular sides is cut to form eight side flaps 70, 72, 74, 76, 78, 80, 82, and 84. As shown, each side flap has a common side with one of the panel sides and the remaining periphery thereof cut. As shown, the back panel 18 has sides 52 and 54 common with side flaps 70 and 80, the outer first side panel 20 has sides 56 and 58 common with side flaps 72 and 82, the outer second side panel 24 has sides 66 and 68 common with side flaps 76 and 84, the inner front panel 14 has its side 46 common with side flap 78 and the outer front panel 22 has its side 60 common with the side flap 74.

The blank 10 is also cut and scored to provide a strut in the form of a strip, generally indicated at 86, which is constructed and arranged in accordance with the principles of the present invention. As shown, the strut 86 is cut from the carton material extending from a pair of corresponding perpendicular sides of two side-by-side panels. In the preferred embodiment shown, the two panels are the partial width first inner side panel 12 and the inner front panel 14 and the corresponding sides 40 and 44 thereof are the sides, respectively. Preferably, the strut 86 is of generally rectangular configuration and is formed with three longitudinally spaced transversely extending crease lines 88, 90, and 92, which serve to divide the same into first and second end portion 94 and 96 and a central portion of two adjacent sections 98 and 100. The strut is cut from the carton material along three of its sides and the end portion of the remaining sides are common with the sides 40 and 44 of the panels 12 and 14 so as to form hinge connections for the strut therewith. A cut-out 102 is provided between the central portion 98-100 of the remaining side and the adjacent sides 40 and 44 of the panels 12 and 14. The central portion section 98 is provided with two crease lines 104 extending between the transverse crease lines 88 and 90 defining the section 98 so as to strengthen the same against bending.

As previously indicated, the blank 10 is preferably constructed so as to be erectable into a shadow box type carton. A carton of this type when completely erected provides at least one panel structure which is capable of having an object to be displayed and contained in shadow box fashion moved through the panel structure to the interior space of the carton. The manner in which the panel structure which permits such function is cut and scored is dependent to a considerable extent upon the configuration of the object which is to be retained in shadow box fashion. FIG. 5 illustrates an object, generally indicated at 106, which performs an air deodorant function and which is configured in the shape of a mushroom. The inner and outer front panels 14 and 22 are cut and scored to permit entry of the object 106 therethrough into the interior space so as to be retained therein in shadow box fashion. To this end, the inner front panel 14 is formed with a crease line 108 extending from the common side 26 thereof to the common side 28 thereof at a position spaced from the perpendicular side 44 a distance generally equal to or slightly greater than the width of the strut 86. The remaining portion of the inner front panel 14 includes a continuous cut 110 extending from one common side 26 to the opposite common side 28 in an intermediate position, the cut 110 including a central semi-circular portion having two notches therein. The portion of the inner front panel 14 between the cut 110 and the crease line 108 also is cut along the common sides 26 and 28 so as to form a strut engaging flap 112. The portion of the inner front panel 14 between the cut 110 and the side 46 has its common sides 26 and 28 cut from the ends of the cut toward the side 46 to a point spaced closely thereto, the cut extending laterally for a short distance into the adjacent panels 12 and 16, as indicated at 114. The cuts 114 define an object retaining flap 116 and a resilient connection between the flap 116 and the adjacent panels 12 and 16.

The outer front panel 22 is formed with a heavy perforation 118 extending between the common sides 34 and 36 thereof at a position corresponding with the position of the crease line 108. The portion of the outer front panel between the perforation 118 and the side 62 is formed with a mushroom engaging cut-out 120 and a central perforation 122. It will be noted that the side 62 is not cut in a perpendicular straight line but rather in a somewhat double mirror image concave configuration providing an angular notch in each half of the associated portion of the panel 22. The portion of the outer front panel 22 defined by the sides 34, 36, and 62, the straight perforation 118, the cut out 120, and central perforation 122, defining a pair of shadow box side flaps 124.

Figure 2:
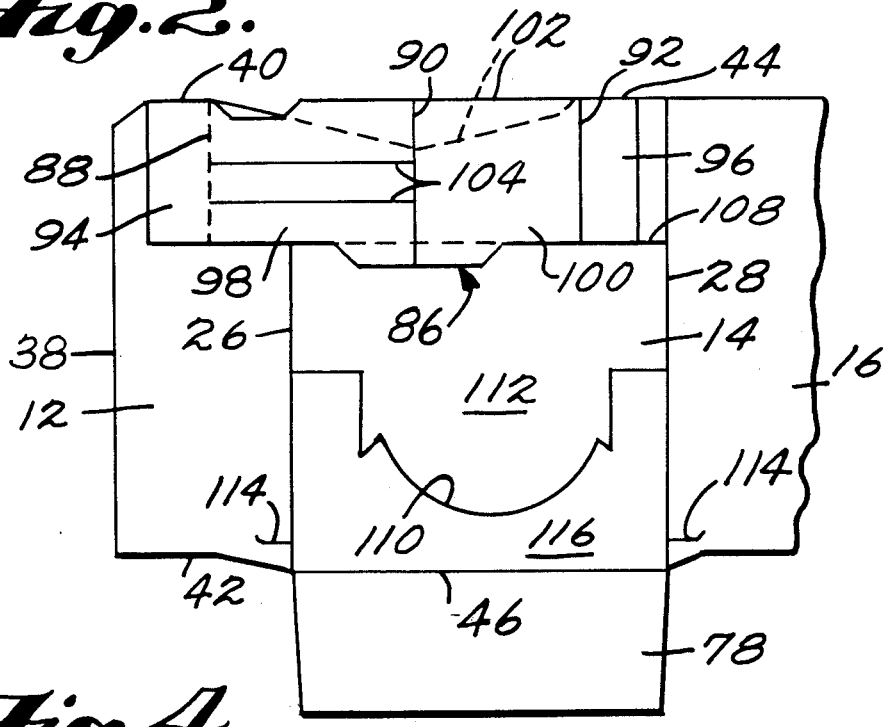
FIG. 2 is an enlarged fragmentary view similar to FIG. 1 illustrating an initial fold of the blank during the formation thereof into a flattened preform condition.

As best shown in FIG. 2, the first step in folding the flat blank 10 into its flattened preformed condition is to fold the strut 86 along the hinge connections provided by the common sides 40 and 44 so as to bring the surfaces of the end portions 94 and 96 into surface-to-surface engagement with contiguous portions of the panels 12 and 14 respectively. The end portions are then suitably secured in such surface-to-surface relation as by heat-activated glue or the like indicated by stippling in FIG. 1. It will be understood that the surface of the blank 10 which is shown in FIG. 1 constitutes the interior surface of each panel in relation to the erected carton. Stated differently, the opposite surface of the panel shown forms the exterior of the carton when erected.

After the strut has been folded as shown in FIG. 2, the panels 12 and 14 together with the folded strut 86 are folded as a unit along the common side 28 so that the interior surfaces of the panels 12 and 14 come into contact with the interior surfaces of the panels 16 and 18. Next, the four panels 12, 14, 16, and 18 are folded as a unit with respect to the remaining three panels 20, 22, and 24 along the common side 32 so as to bring the exterior surfaces of the panels 12 and 14 into surface-to-surface engagement with the interior surfaces of the panels 20 and 22 respectively with the common sides 26 and 34 respectively being disposed in alignment. The interior surface of the panel 20 is provided with a strip of glue adjacent the common side 34 as is indicated by stippling in FIG. 1. The glue serves to secure the exterior surface of the panel 12 to the interior surface of panel 20.

Figure 4:
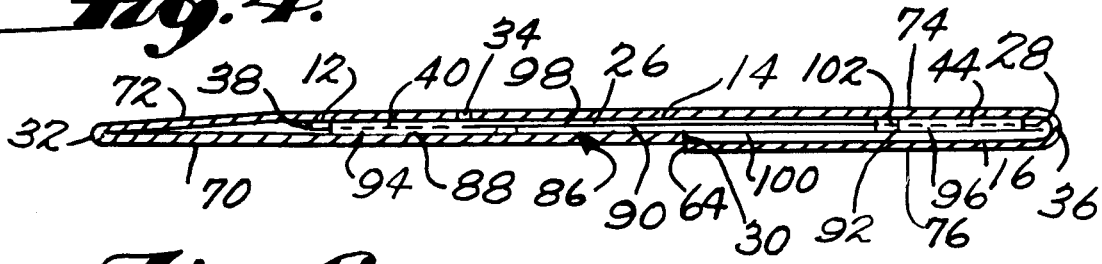
FIG. 4 is an enlarged sectional view taken along the line 4—4 of FIG. 3.

It will also be noted from FIG. 1 that the interior surface of the panel 24 adjacent the cut side 64 is formed with a strip of glue, indicated by stippling in FIG. 1, which, when the panel 24 is folded along the common side 36 to bring the interior surface of the panel 24 into engagement with the exterior surface of the panel 16 serves to secure the inner and outer side panels 16 and 24 in surface-to-surface engagement. The flattened preformed condition of the blank 10 described above is shown in FIGS. 3 and 4 and it will be noted that the inner partial width first side panel 12 glued in lapped relation to the outer first side panel 20 constitutes a first side panel structure which is disposed in side-by-side relation with a front panel structure consisting of the inner front panel 14 and outer front panel 22 disposed in lapped relation. Moreover, the inner second side panel 16 glued in lapped relation with the outer second side panel 24 constitutes a second side panel structure which is disposed in side-by-side relationship to a back panel structure formed by the back panel 18. Consequently in the flattened preformed condition the blank provides a first pair of side-by-side panel structures which are disposed in surface-to-surface coextensive relationship with respect to a second pair of side-by-side panel structures.

Figure 6:
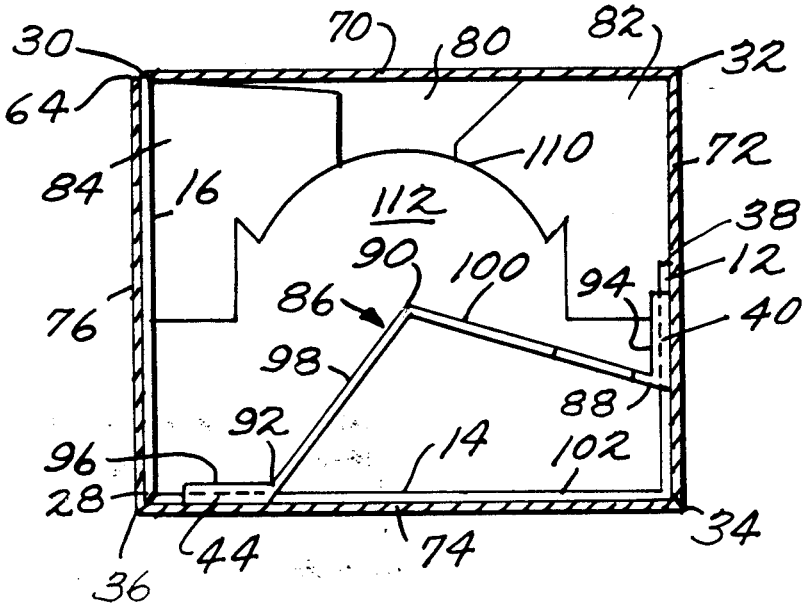
FIG. 6 is a sectional view taken along the line 6—6 of FIG. 5.

It is contemplated that a stack of blanks in flattened preform condition would be fed to carton erecting and packaging forming equipment (not shown). The equipment would serve to erect the blank from its flattened preform condition into a rectangular tubular condition in which the pairs of side-by-side panel structures are moved into perpendicular relationship with respect to one another. Since the panels 12 and 14 form a part of a pair of side-by-side panel structures which are moved into perpendicular relationship, the end portions 94 and 96 of the strut 86 will likewise be moved into perpendicular relationship with respect to one anohter. The creases 104 prevent the central section 98 of the strut 86 from buckling and facilitate the hinged movement of both central portion sections 98 and 100 about crease lines 88, 90 and 92 so that the sections 98 and 100 of the central portion of the strut 86 assume an angular relationship with respect to one another within the space defined by the rectangular tubular orientation of the blank. This angular relationship is shown in FIG. 6. Specifically, an angle of approximately 113° is included between the two strut sections 98 and 100.

The side flaps 70, 72, 74 and 76 on one of the corresponding sides of the panels are hinged into closing relation to the rectangular space defined by the two pairs of perpendicular panel structures. Similarly, the remaining side tabs 78, 80, 82 and 84 are likewise hinged into closing relation with the opposite side of the rectangular tubular configuration. It will be understood that the side flaps at both sides of the panels are suitably secured in their closed positions as by glue or the like. After the blank has been assembled into a full six-sided carton in the manner noted above, the packaging equipment is then operable to open the flaps 112, 116, and 124 of the front panels 14 and 22 and to move an object through the panels into the interior space provided by the erect carton. During this movement, it will be noted that the object retaining flap 116 is initially pivoted downwardly into an entry position enabling the lower end of the object 106 to pass beyond the central portion of the cut 110. Thereafter, by virtue of the resiliency of connection of the flap 116 through cuts 114 to panels 12 and 16, the flap 116 moves upwardly into a retaining position wherein the concave circular portion of the cut 110 engages the adjacent lower portion of the object 106. Similarly, the strut-engaging flap 112 is moved about the crease line 108 into a position of engagement with the central sections 98 and 100 of the strut 86, thus retaining the upper end of the object 106 against movement in the vertical direction of the side tab closures. Finally, it will be noted that side flaps 124 are hinged inwardly so that the angular notches in the sides 62 enter the notches in the cut 110 of flap 116, thus retaining all of the flaps in a shadow box defining relationship with respect to the object 106. The surfaces of the side flaps 124 which are defined by the perforations 118 engage the flap 112 and serve to retain the same in its inwardly and upwardly hinged position in engagement with the strut 86.

It thus will be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. In an erectable carton comprising a flat blank of carton material cut and scored to form an array of side-by-side panels joined along common sides, each defined by four sides including one or two of said common sides, a strut cut from the carton material, and side flaps cut from the carton material extending from certain of the remaining sides of said panels other than said common sides, said blank being folded along said common sides and secured in lapped relation in a flattened preform condition so as to form a first pair of side-by-side panel structures disposed in abutting coextensive relation with a second pair of side-by-side panel structures, said blank being erectable from said flattened preform condition into a rectangular tubular condition wherein each pair of side-by-side panel structures are moved from said side-by-side relation into a perpendicular relationship with one another and said strut is moved within a side portion of the space defined by said pairs of perpendicularly related panel structures with said side flaps being foldable about their associated panel sides into side-closing relation with respect to said space, one of said panel structures being cut and scored to permit entry of an object therethrough into the remaining portion of said space and to retain the object in shadow box fashion against unwanted movement in a direction outwardly through said one panel structure while said strut prevents movement in a direction between the closed side flaps, the improvement which comprises said strut being cut from the carton material extending from a corresponding pair of said remaining non-common sides of two of said side-by-side panels which are retained in side-by-side relation as part of one pair of said side-by-side panel structures when said blank is in said flattened preform condition, said strut including a first end portion having an integral hinge connection with one of said two panels along said corresponding side thereof, a substantial central portion free of connection with said corresponding sides of said two panels and a second end portion having an integral hinge connection with the other of said two panels along said corresponding side thereof, said strut being foldes along said hinge connections so as to bring said first end portion into surface-to-surface engagement with the one of said two panels and said second end portion into surface-to-surface engagement with the other of said two panels, and means for securing said first and second strut end portions in said surface-to-surface engagement.

2. The improvement as defined in claim 1 wherein the central portion of said strut includes three longitudinally spaced transversely extending crease lines dividing the same from said end portions into two sections operable to assume an angular relationship with respect to one another and with said end portions when the blank is erected into said rectangular tubular condition.

3. The improvement as defined in claim 2 wherein one section of said central portion extends across the common side of said two panels when said blank is in said flattened preform condition, said one section having a central crease line extending perpendicular to said common side for resisting transverse bending thereof during erection from said preform condition.

4. The improvement as defined in claim 3 wherein the angular relationship between said strut central portion sections is approximately 113°.

5. The improvement as defined in claim 4 wherein said means securing said end portion in said surface-to-surface engagement comprises glue between the engaged surfaces.

6. The improvement as defined in claim 5 wherein the array of panels formed from said blank is seven in number, said two panels being at one free side of the array, one of said two panels constituting a partial inner first side panel, the other of said two panels constituting an inner front panel, the array of seven panels further including a third panel having one of said common sides with said inner front panel constituting an inner second side panel, a fourth panel having one of said common sides with said inner second side panel constituting a back panel, a fifth panel having one of said common sides with said back panel constituting an outer first side panel, a sixth panel having one of said common sides with said outer first side panel constituting an outer front panel and a seventh panel having one of said common sides with said outer front panel constituting an outer second side panel, said blank when in said flattened preform condition having (1) said partial inner first side panel glued in lapped surface-to-surface engagement with said outer first side panel to form a first side panel structure, (2) said inner and outer side panels lapped to form a second side panel structure, and (3) said inner and outer front panels lapped to form a front panel structure, said first side panel structure and said front panel structure constituting said first pair of side-by-side side panel structures, said second side panel structure and said back panel constituting said second pair of side-by-side panel structures.

7. The improvement as defined in claim 6 wherein said inner front panel is cut to provide a strut-engaging flap movable inwardly along an intermediate hinge line into a position of engagement between the strut and the object.

8. The improvement as defined in claim 7 wherein said inner front panel also includes an object-retaining flap movable inwardly into an entry position to permit entry of the object and then into a retaining position with respect to the object.

9. The improvement as defined in claim 8 wherein said outer front panel includes a pair of side flaps movable inwardly along crease lines at the common sides thereof for engaging and moving inwardly said strut-engaging flap and said object-retaining flap.

10. The improvement as defined in claim 1 wherein said means securing said end portions in said surface-to-surface engagement comprises glue between the engaged surfaces.

11. The improvement as defined in claim 1 wherein the number of panels formed from said blank is seven, said two panels being at one free side of the array, one of said two panels constituting a partial inner first side panel, the other of said two panels constituting an inner front panel, constituting an inner front panel, the array of seven panels further including a third panel having one of said common sides with said inner front panel constituting an inner second side panel, a fourth panel having one of said common sides with said inner second side panel constituting a back panel, a fifth panel having one of said common sides with said back panel constituting an outer first side panel, a sixth panel having one of said common sides with said outer first side panel constituting an outer front panel and a seventh panel having one of said common sides with said outer front panel constituting an outer second side panel, said blank when in said flattened preform condition having (1) said partial inner first side panel glued in lapped surface-to-surface engagement with said outer first side panel to form a first side panel structure, (2) said inner and outer second side panels lapped to form a second side panel structure, and (3) said inner and outer front panels lapped to form a front panel structure, said first side panel structure and said front panel structure constituting said first pair of side-by-sie panel structures, said second side panel structure and said back panel constituting said second pair of side-by-side panel structures.

12. The improvement as defined in claim 11 wherein said inner front panel is cut to provide a strut-engaging flap movable inwardly along an intermediate hinge line into a position of engagement between the strut and the object.

13. The improvement as defined in claim 12 wherein said inner front panel also includes an object-retaining flap movable inwardly into an entry position to permit entry of the object and then into a retaining position with respect to the object.

14. The improvement as defined in claim 13 wherein said outer front panel includes a pair of side flaps movable inwardly along crease lines at the sides of the contiguous panels for engaging and moving inwardly said strut-engaging flap and said object-retaining flap.

15. In a flat blank of carton material cut and scored to form an array of side-by-side panels joined along common sides, each defined by four sides including one or two of said common sides, a strut cut from the carton material, and side flaps cut from the carton material extending from certain of the remaining sides of said panels other than said common sides, said blank being foldable along said common sides and securable in lapped relation in a flattened preform condition so as to form a first pair of side-by-side panel structures disposed in abutting coextensive relation with a second pair of side-by-side panel structures, said blank being erectable from said flattened preform condition into a rectangular tubular condition wherein each pair of side-by-side panel structures are moved from said side-by-side relation into a perpendicular relationship with one another and said strut is moved within a side portion of the space defined by said pairs of perpendicularly related panel structures with said side flaps being foldable about their associated panel sides into side-closing relation with respect to said space, one of said panel structures being cut and scored to permit entry of an object therethrough into the remaining portion of said space and to retain the object in shadow box fashion against unwanted movement in a direction outwardly through said one panel structure while said strut prevents movement in a direction between the closed side flaps, the improvement which comprises said strut being cut from the carton material extending from a corresponding pair of said remaining non-common sides of two of said side-by-side panels, said strut including a first end portion having an integral hinge connection with one of said two panels along said corresponding side thereof, a substantial central portion free of connection with said corresponding sides of said two panels and a second end portion having an integral hinge connection with other of said two panels along said corresponding side thereof.

16. The improvement as defined in claim 15 wherein the central portion of said strut includes three longitudinally spaced-transversely extending crease lines dividing the same from said end portions into two sections.

17. The improvement as defined in claim 16 wherein the array of panels formed from said blank is seven in number, said two panels being at one free side of the array, one of said two panels constituting a partial inner first side panel, the other of said two panels constituting an inner front panel, constituting an inner front panel, the array of seven panels further including a third panel having one of said common sides with said inner front panel constituting an inner second side panel, a fourth panel having one of said common sides with said inner second side panel constituting a back panel, a fifth panel having one of said common sides with said back panel constituting an outer first side panel, a sixth panel having one of said common sides with said outer first side panel constituting an outer front panel and a seventh panel having one of said common sides with said outer front panel constituting an outer second side panel.

18. The improvement as defined in claim 17 wherein said inner front panel is cut to provide a strut-engaging flap movable inwardly along an itermediate hinge line into a position of engagement between the strut and the object.

19. The improvement as defined in claim 18 wherein said inner front panel also includes an object-retaining flap movable inwardly into an entry position to permit entry of the object and then into a retaining position with respect to the object.

20. The improvement as defined in claim 19 wherein said outer front panel includes a pair of side flaps movable inwardly along crease lines at the common sides thereof for engaging and moving inwardly said strut-engaging flap and said object-retaining flap.

21. A package comprising a carton of flat carton material erected to define an interior space, said carton including first and second flat panels of carton material integrally joined along a common side forming one dimension of the erected carton, said first and second panels having first and second flat surfaces respectively disposed at right angles with respect to one another and defining a portion of said interior space, said first and second panels having first and second perpendicular sides respectively extending outwardly at right angles from one another from one end of said common side, an elongated strip of carton material having a first end portion, a relatively long central portion and a second end portion, said first end portion having a side integral and common with the first perpendicular side of said first panel, said first end portion being hinged along the side thereof common with said first perpendicular side into surface-to-surface engagement with the first surface of said first panel, means for securing said first end portion in said surface-to-surface engagement with said first panel, said second end portion having a side integral and common with said second perpendicular side of said second panel, said second end portion being hinged along the side thereof common with said second perpendicular side into surface-to-surface engagement with said second surface of said second panel, means for securing said second end portion in said surface-to-surface engagement with said second panel, said central portion extending within the interior space between said first and second surfaces.

22. A package as defined in claim 21 wherein the central portion of said strip includes three longitudinally spaced transversely extending crease lines dividing the same into two straight sections disposed at an angle with respect to one another.

23. A package as defined in claim 22 wherein the angle between said straight sections is aproximately 113°.

* * * * *